US008333846B2

(12) United States Patent
Yang et al.

(10) Patent No.: US 8,333,846 B2
(45) Date of Patent: Dec. 18, 2012

(54) MANUFACTURING METHOD OF ORIENTED SI STEEL WITH HIGH ELECTRIC-MAGNETIC PROPERTY

(75) Inventors: Guohua Yang, Shanghai (CN); Huande Sun, Shanghai (CN); Yaming Ji, Shanghai (CN); Guobao Li, Shanghai (CN); Hongxu Hei, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

(21) Appl. No.: 12/934,897

(22) PCT Filed: Mar. 25, 2009

(86) PCT No.: PCT/CN2009/071003

§ 371 (c)(1),
(2), (4) Date: Mar. 4, 2011

(87) PCT Pub. No.: WO2009/117959

PCT Pub. Date: Oct. 1, 2009

(65) Prior Publication Data

US 2011/0139313 A1 Jun. 16, 2011

(30) Foreign Application Priority Data

Mar. 25, 2008 (CN) ..... 2008 1 0035079

(51) Int. Cl.
*H01F 1/147* (2006.01)

(52) U.S. Cl. ..... 148/111; 148/307; 148/308

(58) Field of Classification Search ..... None
See application file for complete search history.

(56) References Cited

U.S. PATENT DOCUMENTS

| | | | | |
|---|---|---|---|---|
| 5,049,205 | A | 9/1991 | Takahashi et al. | |
| 5,653,821 | A * | 8/1997 | Choi et al. | 148/111 |
| 5,711,825 | A * | 1/1998 | Bolling et al. | 148/111 |
| 5,803,988 | A * | 9/1998 | Bae et al. | 148/111 |
| 6,153,019 | A * | 11/2000 | Espenhahn et al. | 148/111 |
| 6,451,128 | B1 * | 9/2002 | Lee et al. | 148/111 |
| 7,976,644 | B2 * | 7/2011 | Ushigami et al. | 148/111 |

FOREIGN PATENT DOCUMENTS

| | | |
|---|---|---|
| CN | 1219977 | 6/1999 |
| CN | 1611617 | 5/2005 |
| CN | 1786248 | 6/2006 |
| CN | 1978707 | 6/2007 |
| EP | 0709470 | 5/1996 |
| KR | 2002-074312 | 9/2002 |
| WO | 9953106 | 10/1999 |

OTHER PUBLICATIONS

International Search Report of PCT/CN2009/071003, dated Jul. 2, 2009.

* cited by examiner

*Primary Examiner* — John Sheehan
(74) *Attorney, Agent, or Firm* — Hamre, Schumann, Mueller & Larson, P.C.

(57) ABSTRACT

A manufacturing method of oriented Si steel with high electric-magnetic property comprises the following steps: smelting steel in converter or electric furnace; refining molten steel in two stages; continuous casting to obtain slab; hot rolling; first cold rolling; decarburizing annealing; secondary cold rolling; applying an annealing separator based on MgO and annealing at high temperature; applying an insulating coating and leveling tension annealing. The slab comprises (in wt %): C 0.020-0.050%, Si 2.6-3.6%, S 0.015-0.025%, Als 0.008-0.028%, N 0.005-0.020%, Mn 0.15-0.5%, Cu 0.3-1.2%, balance Fe and inevitable impurities, in which $10 \leqq Mn/S \leqq 20$ and $Cu/Mn \geqq 2$. The method could produce oriented Si steel with high magnetic induction intensity and low iron loss at low cost.

3 Claims, No Drawings

MANUFACTURING METHOD OF ORIENTED SI STEEL WITH HIGH ELECTRIC-MAGNETIC PROPERTY

TECHNICAL FIELD

The invention relates to a method for producing oriented silicon steel with high electromagnetic performance.

BACKGROUND ART

According to the fairly developed technology for producing conventional grain-oriented (CGO) silicon steel, MnS is adopted as the major inhibitor, and the heating temperature is higher than 1350° C. during hot rolling. Thus, the energy consumption is relatively high, and slag is introduced on the surface of steel billet under such a high temperature. The heating equipment needs regular cleaning, which impacts the output of the product, adds to the energy consumption, raises damage probability of the device, and promotes production cost. Therefore, a great deal of study has been carried out by both native and foreign researchers to lower the heating temperature of silicon steel. According to the developmental trend, there are two ways to modify the technology in terms of the heating temperature range. One way is to control the heating temperature in the range of 1150-1250° C. during hot rolling, which is referred to as low-temperature slab heating technology, by forming inhibitor in later stage via nitriding to acquire inhibition capability. At present, the low-temperature slab heating technology witnesses rapid development, as shown by, for example, U.S. Pat. No. 5,049,205, Chinese Patent CN 1978707 and South Korean Patent KR2002074312. However, additional nitriding equipment is needed in these methods, leading to increased cost and inconsistent magnetism of the final product due to uneven nitriding.

In the other way, the heating temperature is held in the range of 1250-1320° C. during hot rolling. As distinguished from the low-temperature technology, this may likely be referred to as medium-temperature slab heating technology. According to the medium-temperature slab heating technology, an inhibitor containing Cu is used, and the smelted and continuously cast slab is subjected to twice cold rollings, between which intermediate decarburizing annealing (one-off decarburizing annealing) is carried out to lower the carbon content to less than 30 ppm. After the secondary cold rolling, the MgO separator is coated immediately or after recovery annealing at low temperature, followed by high-temperature annealing and subsequent treatment. The technical solutions disclosed in European Patent EP 0709470 and Chinese Patent CN 1786248A belong to the medium-temperature slab heating technology. The common problem of these two patents is the excessively low content of sulfur, which leads to inadequate amount and uneven distribution of the inhibitor. As a result, local or entire inhibiting capability is impacted, so that secondary recrystallization is not brought about to its full extent, and magnetic performance is degraded and unhomogenized.

SUMMARY OF THE INVENTION

The object of the invention is to provide a method for producing oriented silicon steel with high electromagnetic performance. Specifically, desirable secondary recrystallization and underlying layer quality are achieved by controlling the composition of a slab and the process, so as to arrive at the aim of promoting the electromagnetic performance of oriented silicon steel.

The invention is realized by a method for producing oriented silicon steel (grain-oriented silicon) with high electromagnetic performance, comprising: smelting steel in a converter or an electric furnace; secondarily refining and continuously casting the molten steel to obtain a slab, followed by hot rolling, primary cold rolling, decarburizing annealing, secondary cold rolling; applying an annealing separator comprising magnesium oxide as the main component; then annealing at high temperature; and finally applying an insulating coating and carrying out stretch-leveling annealing (i.e., leveling tension annealing), wherein the slab has the following composition based on weight percentage:

C: 0.020%~0.050%;
Si: 2.6%~3.6%;
S: 0.015%~0.025%;
Als: 0.008%~0.028%;
N: 0.005%~0.020%;
Mn: 0.15%~0.5%, and $10 \leqq Mn/S \leqq 20$;
Cu: 0.3%~1.2%, and $Cu/Mn \geqq 2$;
balanced by Fe and unavoidable inclusions. Als represents acid soluble aluminum.

The process of hot rolling comprises: heating the slab to 1250-1350° C. in a heating furnace; holding this temperature for 2-6 hours; and then hot rolling, wherein the hot finish rolling begins at 1050-1200° C., and ends at above 800° C.

The hot finish rolling begins at 1070-1130° C., and ends at above 850° C.

After hot rolling, a hot rolled sheet of 2.0-2.8 mm in thickness is obtained.

And then acid washing and primary cold rolling are carried out to roll the sheet into an intermediate thickness of 0.50-0.70 mm.

Subsequently, intermediate decarburizing annealing is carried out, wherein the steel sheet subjected to the intermediate decarburizing annealing is heated to above 800° C. at which temperature the sheet is heated evenly, intermediate decarburizing annealing is done in a protective atmosphere of wet hydrogen for less than 10 minutes, and the carbon content in the annealed steel sheet is lowered to less than 30 ppm.

After the intermediate decarburizing annealing, secondary cold rolling is carried out to obtain a final product of 0.15-0.35 mm in thickness.

An annealing separator comprising magnesium oxide as the main component is applied on the steel sheet.

Finally, high-temperature annealing is carried out. The process comprises annealing in a dry atmosphere (i.e. dew point D.P. <0° C.) of hydrogen or mixed gas of nitrogen and hydrogen where hydrogen accounts for over 75%, at 1170-1230° C. which is held for over 15 hours.

By formulating the composition of the slab in the invention, sulfur content is increased, specifically, S: 0.015%-0.025%, manganese/sulfur ratio: $10 \leqq Mn/S \leqq 20$, and copper/manganese $Cu/Mn \geqq 2$. Thus, the ratio of $Cu_2S$ to MnS in the composition is controlled, so that hot rolling favors precipitation of $Cu_2S$. In addition, the temperatures at which hot rolling begins and ends are controlled strictly in the process of hot rolling, so that most sulfur precipitates in the form of $Cu_2S$ inhibitor, and composite precipitation of $MnS+Cu_2S$ is avoided to the largest extent. Therefore, coarsening and unhomogenization of the inhibitor is prevented. The precipitation temperature of $Cu_2S$ is in the range of 900-1100° C. with a peak precipitation temperature of 1000° C., while the peak precipitation temperature of MnS is higher than 1100° C. Since the temperature at which hot rolling begins is higher than 1050° C., and the temperature at which hot rolling ends is higher than 800° C., precipitation and distribution of adequate $Cu_2S$ is ensured to the largest extent, and composite precipitation of MnS and $Cu_2S$ is inhibited at the same time. Thus, it can be ensured that, in the later stage of the production process, $Cu_2S$ and MN work together to inhibit grain growth in undesirable orientations, and the growth of crystal nuclei in the (100)[001] Gaussian orientation during secondary recrystallization has adequate driving force. As a result, the magnetic performance of the final product is enhanced remarkably.

When its content is high, sulfur tends to segregate at the center of the as-cast microstructure. Therefore, the temperature at which the slab is heated has to be held at above 1250° C. for enough time in order to solid dissolve sulfides at the center adequately, so that adequate $Cu_2S$ will precipitate in dispersed, fine state during subsequent hot rolling.

Owing to a large quantity of fine $Cu_2S$ and a small quantity of MnS in dispersed state during high-temperature annealing, surface desulfurization is slowed down, therefore, inhibiting capability is enhanced, and the temperature of secondary recrystallization is allowed to be increased. Thus, secondary grains are oriented more accurately, so that magnetic performance is promoted.

Due to increase of sulfur content according to the invention, magnetic performance of the product, particularly iron loss performance, will be degraded if sulfur is not removed completely during the final high-temperature annealing. Meanwhile, magnetic aging will occur, and processability of the product will be decreased significantly as well. Thus, there is severe restriction on the purifying annealing time in the high-temperature annealing process. Specifically, the purifying annealing should be carried out in a dry atmosphere of hydrogen or mixed nitrogen and hydrogen which accounts for over 75%, and the purifying annealing temperature of 1170-1230° C. should be held for over 15 hours, wherein "dry atmosphere" means it has a dew point (D.P.) <0° C. Should the temperature be excessively low or the temperature hold time be excessively short, harmful elements such as N, S and the like could not be removed completely, and magnetic performance would be degraded. If the temperature is too high, grains formed during secondary recrystallization would be coarse, accompanied by increased iron loss and degraded glass film quality.

The invention exhibits the following beneficial effects: by designing the composition of the slab and controlling the slab heating and hot rolling conditions according to the invention, the form in which sulfides precipitate during hot rolling is improved effectively and precipitation of $MnS+Cu_2S$ as a composite inhibitor is avoided to the largest extent, so that even precipitation of an adequate amount of fine inhibitors is ensured. As a result, magnetism is increased significantly at low production cost, and iron loss is decreased effectively, so that high magnetic induction grain-oriented silicon steel is obtained.

DETAILED DESCRIPTION OF THE INVENTION

EXAMPLE 1

A group of slabs for oriented silicon steel have different compositions with varying sulfur content, manganese content and copper content. Except for S, Mn and Cu, the weight percentages of the other components remain constant as follows: C: 0.040%, Si: 3.17%, Als: 0.017%, N: 0.01%. The contents of S, Mn and Cu are listed in Table 1, and the balance components are Fe and unavoidable inclusions. The foregoing slabs were treated according to the following process: after held in a heating furnace at a reheating temperature of 1280° C. for 3 hours, they were hot rolled into hot-rolled sheets of 2.5 mm in thickness, wherein it was ensured that the finish rolling began at 1050-1200° C. and ended at above 800° C.; the sheets were primarily cold rolled after acid washing to a thickness of 0.65 mm, and then intermediate decarburizing annealing was carried out at 850° C. in a wet protective atmosphere of hydrogen to lower carbon content in the steel sheets to below 30 ppm; the resultant sheets were secondarily cold rolled after the intermediate decarburizing annealing to 0.30 mm, the thickness of the products; the resultant sheets were coated with a separator with MgO as the main component, coiled and subjected to high-temperature annealing in an atmosphere of 100% $H_2$ with D.P. −10° C. at 1200° C. for 20 hours; and final products were obtained after uncoiled, coated with an insulating coating and stretch-leveling annealed. The magnetic performances of the final products are shown in Table 1 (the magnetic performance reference of a high magnetic induction oriented silicon steel product is: magnetic flux density B8≧1.88 T, iron loss P17/50≦1.30 W/kg, sic passim).

TABLE 1

Effects of Composition on Magnetic Performance

| Sulfur Content (%) | Manganese Content (%) | Copper Content (%) | Magnetism: Magnetic Flux Density B8(T) | Magnetism: Iron Loss P17/50 (W/kg) | Description |
|---|---|---|---|---|---|
| 0.015% | 0.15% | 0.3% | 1.88 | 1.14 | Inventive Example |
| 0.015% | 0.15% | 0.6% | 1.88 | 1.16 | Inventive Example |
| 0.015% | 0.22% | 0.45% | 1.90 | 1.03 | Inventive Example |
| 0.015% | 0.22% | 0.6% | 1.91 | 1.07 | Inventive Example |
| 0.015% | 0.3% | 0.6% | 1.89 | 1.13 | Inventive Example |
| 0.015% | 0.3% | 0.8% | 1.88 | 1.18 | Inventive Example |
| 0.020% | 0.2% | 0.4% | 1.90 | 0.99 | Inventive Example |
| 0.020% | 0.2% | 0.6% | 1.91 | 1.01 | Inventive Example |
| 0.020% | 0.3% | 0.6% | 1.90 | 1.05 | Inventive Example |
| 0.020% | 0.3% | 0.8% | 1.90 | 1.12 | Inventive Example |
| 0.020% | 0.4% | 0.8% | 1.89 | 1.10 | Inventive Example |
| 0.020% | 0.4% | 1.0% | 1.88 | 1.21 | Inventive Example |
| 0.025% | 0.25% | 0.5% | 1.90 | 1.08 | Inventive Example |
| 0.025% | 0.25% | 0.6% | 1.90 | 1.15 | Inventive Example |
| 0.025% | 0.32% | 0.65% | 1.90 | 1.17 | Inventive Example |
| 0.025% | 0.32% | 0.8% | 1.88 | 1.19 | Inventive Example |
| 0.025% | 0.5% | 1.0% | 1.88 | 1.21 | Inventive Example |
| 0.025% | 0.5% | 1.2% | 1.88 | 1.23 | Inventive Example |
| 0.010% | 0.15% | 0.6% | 1.84 | 1.32 | Comparative Example |
| 0.020% | 0.15% | 0.6% | 1.86 | 1.28 | Comparative Example |
| 0.020% | 0.2% | 0.3% | 1.84 | 1.35 | Comparative Example |
| 0.020% | 0.3% | 0.4% | 1.82 | 1.39 | Comparative Example |
| 0.020% | 0.4% | 0.6% | 1.82 | 1.42 | Comparative Example |
| 0.020% | 0.5% | 1.1% | 1.79 | 1.59 | Comparative Example |
| 0.030% | 0.4% | 1.0% | 1.67 | 1.65 | Comparative Example |

EXAMPLE 2

The components and their weight percentages of the slabs for oriented silicon steel in this example are as follows: C: 0.032%, Si: 3.2%, Als: 0.012%, N: 0.01%, S: 0.016%, Mn: 0.18%, Cu: 0.42%, balanced by Fe and unavoidable inclusions. After held at a temperature in a heating furnace according to the various reheating Protocols given in Table 2, the slabs were hot rolled into hot-rolled sheets of 2.5 mm in thickness, wherein the temperatures at which the hot finish rolling began and ended were shown in Table 2. The sheets were primarily cold rolled after acid washing to a thickness of 0.60 mm, and then intermediate decarburizing annealing was carried out at 850° C. in a wet protective atmosphere of hydrogen to lower carbon content in the steel sheet to below 30 ppm. The resultant sheets were secondarily cold rolled after the intermediate decarburizing annealing to 0.27 mm, the thickness of the final products. The resultant sheets were coated with a separator with MgO as the main component, coiled and subjected to high-temperature annealing in an atmosphere of 100% 1-12 with D.P. −10° C. at 1200° C. for 20 hours. Final products were obtained after uncoiled, coated with an insulating coating and stretch-leveling annealed. The magnetic performances of the final products are shown in Table 2.

TABLE 2

Effects of Composition, Slab Heating Protocol and Hot Rolling Protocol on Magnetic Performances

| Slab Heating Protocol | Temperature At Which Hot Finish Rolling Began | Temperature At Which Hot Finish Rolling Ended | Magnetism: Magnetic Flux Density B8(T) | Magnetism: Iron Loss P17/50(W/kg) | Description |
|---|---|---|---|---|---|
| 1250° C. × 2 h | 1050° C. | 800° C. | 1.88 | 1.21 | Inventive Example |
| 1250° C. × 2 h | 1200° C. | 800° C. | 1.88 | 1.19 | Inventive Example |
| 1250° C. × 2 h | 1100° C. | 850° C. | 1.89 | 1.15 | Inventive Example |
| 1250° C. × 2 h | 1100° C. | 876° C. | 1.89 | 1.12 | Inventive Example |
| 1280° C. × 2 h | 1100° C. | 890° C. | 1.90 | 1.11 | Inventive Example |
| 1250° C. × 2 h | 1070° C. | 869° C. | 1.90 | 1.14 | Inventive Example |
| 1250° C. × 2 h | 1130° C. | 912° C. | 1.91 | 1.03 | Inventive Example |
| 1250° C. × 3 h | 1100° C. | 907° C. | 1.91 | 1.02 | Inventive Example |
| 1280° C. × 3 h | 1100° C. | 930° C. | 1.90 | 1.06 | Inventive Example |
| 1250° C. × 1.5 h | 1100° C. | 865° C. | 1.66 | 1.67 | Comparative Example |
| 1280° C. × 1.5 h | 1100° C. | 874° C. | 1.68 | 1.63 | Comparative Example |
| 1280° C. × 3 h | 1000° C. | 867° C. | 1.79 | 1.45 | Comparative Example |
| 1280° C. × 3 h | 1250° C. | 948° C. | 1.85 | 1.34 | Comparative Example |
| 1280° C. × 3 h | 1100° C. | 764° C. | 1.82 | 1.39 | Comparative Example |

EXAMPLE 3

The components and their weight percentages of the slab for oriented silicon steel in this example is as follows: C: 0.032%, Si: 3.2%, Als: 0.012%, N: 0.01%, S: 0.016%, Mn: 0.18%, Cu: 0.42%, balanced by Fe and unavoidable inclusions. After held at 1280° C. in a heating furnace for 3 hours, the slab was hot rolled into a hot-rolled sheet of 2.5 mm in thickness, wherein the temperatures at which the hot finish rolling began and ended were 1100° C. and 930° C. respectively. The sheet was primarily cold rolled after acid washing to a thickness of 0.60 mm, and then intermediate decarburizing annealing was carried out at 850° C. in a wet protective atmosphere of hydrogen to lower carbon content in the steel sheet to below 30 ppm. The resultant sheet was secondarily cold rolled after the intermediate decarburizing annealing to 0.27 mm, the thickness of the final product. The resultant sheet was coated with a separator with MgO as the main component, and then treated according to various high-temperature annealing processes as shown in Table 3 to test their effects on the magnetism of the final products. Final products were obtained after coated with an insulating coating and stretch-leveling annealed. The magnetic performances of the final products are shown in Table 3.

TABLE 3

Effects of High-temperature Annealing Processes on Magnetism

| Hold | | Hydrogen Content in Protective | | Magnetism | | |
|---|---|---|---|---|---|---|
| Temperature in High-temperature Annealing (° C.) | Hold Time in High-temperature Annealing (h) | Atmosphere during Annealing (Mixed Gas of Nitrogen and Hydrogen) (%) | D.P. during Annealing (° C.) | Magnetic Flux Density B8(T) | Iron Loss P17/50 (W/kg) | Description |
| 1170 | 15 | 100 | −1 | 1.89 | 1.11 | Inventive Example |
| 1170 | 15 | 75 | −1 | 1.88 | 1.13 | Inventive Example |
| 1230 | 15 | 75 | −1 | 1.88 | 1.12 | Inventive Example |
| 1230 | 15 | 100 | −1 | 1.89 | 1.09 | Inventive Example |
| 1170 | 15 | 100 | −10 | 1.89 | 1.07 | Inventive Example |
| 1200 | 15 | 100 | −10 | 1.90 | 1.06 | Inventive Example |
| 1200 | 20 | 100 | −10 | 1.90 | 1.04 | Inventive Example |
| 1150 | 20 | 100 | −10 | 1.85 | 1.48 | Comparative Example |
| 1300 | 20 | 100 | −10 | 1.86 | 1.39 | Comparative Example |
| 1200 | 12 | 100 | −10 | 1.82 | 1.55 | Comparative Example |
| 1200 | 20 | 100 | 0 | 1.87 | 1.30 | Comparative Example |
| 1200 | 20 | 100 | 10 | 1.86 | 1.36 | Comparative Example |
| 1200 | 20 | 50 | −10 | 1.83 | 1.42 | Comparative Example |

The invention claimed is:

1. A method for producing oriented silicon steel with high electromagnetic performance, comprising:

smelting steel in a converter or an electric furnace;

secondarily refining and continuously casting the molten steel to obtain a slab, followed by hot rolling, primary cold rolling, decarburizing annealing, secondary cold rolling;

applying an annealing separator comprising magnesium oxide as the main component;

then annealing at high temperature; and finally applying an insulating coating and carrying out stretch-leveling annealing, wherein the slab has the following composition based on weight percentage:

C: 0.020%~0.050%;

Si: 2.6%~3.6%;

S: 0.015%~0.025%;

Als: 0.008%~0.028%;

N: 0.005%~0.020%;

Mn: 0.15%~0.5%, and $10 \leqq Mn/S \leqq 20$;

Cu: 0.3%~1.2%, and $Cu/Mn \geqq 2$; and balance components including Fe and unavoidable inclusions, wherein the process of high-temperature annealing comprises annealing in a dry atmosphere of hydrogen or mixed nitrogen and hydrogen where hydrogen accounts for over 75%, at 1170-1230° C. which is held for over 15 hours.

2. The method of claim 1 for producing oriented silicon steel with high electromagnetic performance, wherein the process of hot rolling comprises: heating the slab to 1250-1350° C. in a heating furnace; holding this temperature for 2-6 hours; and then hot rolling, wherein the hot finish rolling begins at 1050-1200° C., and ends at above 800° C.

3. The method of claim 2 for producing oriented silicon steel with high electromagnetic performance, wherein the hot finish rolling begins at 1070-1130° C., and ends at above 850° C.

* * * * *